US009683800B2

(12) United States Patent
Sewell, Jr. et al.

(10) Patent No.: US 9,683,800 B2
(45) Date of Patent: Jun. 20, 2017

(54) SEMI-AUTOMATIC RIFLE

(71) Applicant: FN America, LLC, McLean, VA (US)

(72) Inventors: Rob Wayne Sewell, Jr., Columbia, SC (US); Edward Paul Schmitter, Eastover, SC (US); Trenton Allen Newsome, Elgin, SC (US); Daryl Matthew Atkins, Lugoff, SC (US)

(73) Assignee: FN America, LLC, McLean, VA (US)

( * ) Notice: Subject to any disclaimer, the term of this patent is extended or adjusted under 35 U.S.C. 154(b) by 8 days.

(21) Appl. No.: 14/968,131

(22) Filed: Dec. 14, 2015

(65) Prior Publication Data

US 2016/0290753 A1 Oct. 6, 2016

Related U.S. Application Data

(60) Provisional application No. 62/142,259, filed on Apr. 2, 2015.

(51) Int. Cl.

| | |
|---|---|
| ***F41A 19/45*** | (2006.01) |
| ***F41A 3/72*** | (2006.01) |
| ***F41A 19/14*** | (2006.01) |
| ***F41A 5/26*** | (2006.01) |
| *F41A 3/66* | (2006.01) |
| *F41A 21/44* | (2006.01) |
| *F41C 23/16* | (2006.01) |

(52) U.S. Cl.

CPC ..... *F41A 19/45* (2013.01); *F41A 3/72* (2013.01); *F41A 5/26* (2013.01); *F41A 19/14* (2013.01); *F41A 3/66* (2013.01); *F41A 21/44* (2013.01); *F41C 23/16* (2013.01)

(58) Field of Classification Search

CPC .... F41A 19/45; F41A 3/72; F41A 5/26; F41A 19/14; F41A 3/66; F41A 21/44; F41A 23/16

USPC ..... 89/136, 132, 139, 199, 33.03, 33.04, 89/33.14, 33.16, 33.2, 33.25, 33.5, 34, 89/35.01; 42/18

See application file for complete search history.

(56) References Cited

U.S. PATENT DOCUMENTS

| | | | | |
|---|---|---|---|---|
| 3,136,213 | A * | 6/1964 | Reed | F41A 9/55 89/33.25 |
| 4,448,109 | A | 5/1984 | Johnson | |
| 5,760,328 | A | 6/1998 | Robbins | |
| 6,125,735 | A | 10/2000 | Guhring | |
| 7,568,421 | B2 * | 8/2009 | Cummings | F41A 9/49 42/87 |
| 7,600,338 | B2 | 10/2009 | Geissele | |
| 7,654,187 | B2 | 2/2010 | Hochstrate et al. | |
| 7,676,974 | B2 | 3/2010 | Zemanek | |
| 7,806,039 | B1 | 10/2010 | Gomez | |
| 7,895,933 | B2 | 3/2011 | Quis | |
| 7,950,178 | B1 | 5/2011 | Landies et al. | |

(Continued)

*Primary Examiner* — John D Cooper

(74) *Attorney, Agent, or Firm* — Nexsen Pruet, LLC; Michael A. Mann

(57) ABSTRACT

A semi-automatic rifle is configured to fire single rounds of ammunition via a magazine or a belt of ammunition. A receiver cover pivots open to receive the first round of a belt of ammunition or a magazine can be inserted in a magazine well. The rifle operates using a closed bolt firing cycle, with a sliding hammer that, on its return from recoil after firing a first round, is caught by a sear regardless of whether the trigger is still in the pulled position. The trigger must be fully released before a second round can be fired.

19 Claims, 18 Drawing Sheets

(56) References Cited

U.S. PATENT DOCUMENTS

| | | | | |
|---|---|---|---|---|
| 8,047,119 | B2 | 11/2011 | Hochstrate et al. | |
| 8,087,343 | B2 | 1/2012 | Landies et al. | |
| 8,136,440 | B1 * | 3/2012 | Shirts | F41A 9/29 89/33.14 |
| 8,397,617 | B2 | 3/2013 | Shirts et al. | |
| 2003/0126781 | A1 * | 7/2003 | Herring | F41A 5/26 42/18 |
| 2007/0051236 | A1 | 3/2007 | Groves et al. | |
| 2007/0266845 | A1 | 11/2007 | Polston | |
| 2010/0319528 | A1 * | 12/2010 | Kenney | F41A 5/26 89/193 |
| 2011/0146484 | A1 * | 6/2011 | Landies | F41A 19/27 89/128 |
| 2012/0144992 | A1 | 6/2012 | Landies et al. | |
| 2012/0144993 | A1 | 6/2012 | Landies et al. | |
| 2012/0167433 | A1 | 7/2012 | Robbins et al. | |
| 2013/0047828 | A1 * | 2/2013 | Smith | F41A 9/01 89/33.14 |
| 2014/0318362 | A1 | 10/2014 | Hochstrate et al. | |
| 2014/0331853 | A1 * | 11/2014 | St. George | F41A 5/20 89/191.02 |

* cited by examiner

SEMI-AUTOMATIC RIFLE

TECHNOLOGICAL FIELD

The present disclosure relates generally to firearms. More specifically, it relates to semi-automatic rifles.

BACKGROUND

Firearms for hunting and sport shooting come in a range of types, such as traditional hunting rifles with wood butt stocks and fore stocks to military type rifles. In the latter group, there is an interest in rifles that have military ruggedness and appearance but meet requirements for ownership and use, such as, for example, a limitation to semi-automatic mode rather than fully-automatic operation. Semi-automatic mode means that the trigger must be released for the next round to be fired. If the trigger is pulled but not released, one round only is fired.

BRIEF SUMMARY

The present disclosure is of a rifle having the features typical of light machine guns but operating only in semi-automatic mode. For example, it may be fed ammunition using an ammunition belt, its receiver has a pivoting cover to admit the first round of the belt, and it has charging handle similar to those of military machine guns.

The present rifle has a barrel, a buttstock, a receiver, and a trigger. The barrel has a forward end and an opposing rearward end and may be covered on top and on the bottom by a heat shielding. A breech is formed in the rearward end of the barrel where it is joined to the forward end of the receiver. A buttstock is attached to the rearward end of the receiver. The trigger is held within a trigger housing attached to the underside of the receiver. The trigger housing may also include a pistol grip.

A feature of the present rifle is that the receiver is configured to receive ammunition from a belt and, according to the preference of the user, from a magazine without modification. It has a magazine well to receive an ammunition magazine and a ramp for belt-fed ammunition with a receiver top cover that pivots open to allow the first round of a belt of ammunition to be put in position for loading into the breech.

The present rifle includes a bolt, a firing pin carried by the bolt, a sliding hammer, and a spring system for urging the hammer to move forward in the receiver to strike the firing pin. The operation of the bolt seats the next round, extracts the spent cartridge casing after firing, and pulls into position the next round as part of the firing cycle. The trigger assembly includes a trigger, a sear, and a disconnector that pivots the sear when the trigger is pulled. The sear automatically catches the hammer on recoil and holds it until the disconnector, lifted by the pull of the trigger, again pivots the sear to release the hammer.

The charging handle is on the right side of the receiver with a forward and rearward position and is used to seat the first round in the breech. The present rifle has a broad heat shield extending over, and a hand guard under, the barrel, and a mid-position carrying handle that adds to the light-machine gun appearance of the present semi-automatic rifle.

Another feature of the disclosure is that the firing pin is slidably carried within the bolt so that the pin travels with the bolt but also moves with respect to the bolt when the pin is struck by the sliding hammer.

Another feature of the disclosure is the rails formed on the interior of the receiver housing. The hammer rides on the rails between the forward end of the receiver and the rearward end.

A feature of the disclosure is a spring that urges the trigger to move against a second pin in the trigger housing, after the trigger returns to the released position, with an audible and tactile click so that the user hears and feels that the trigger has seated in the released position and that, therefore, the trigger is again ready to pull in order to fire another round of ammunition.

These and other features and their advantages will be apparent to those skilled in the firearm arts from a careful reading of the detailed description of preferred embodiments accompanied by the following drawings.

DETAILED DESCRIPTION

In this disclosure, regarding a rifle, the terms proximal and rearward refer to the "butt stock" end of the rifle and forward or distal refer to the "barrel end" of the rifle, generally consistent with the perspective of a user who is holding the rifle in firing position. Similarly, upward and downward are from the perspective of a user standing and holding the firearm in normal orientation, that is, with the trigger oriented to extend toward the earth. The terms left side and right side are from the perspective of someone aiming the rifle. When introducing elements of the present disclosure or exemplary aspects or embodiment(s) thereof, the articles "a," "an," "the" and "said" are intended to mean that there are one or more of the elements. The terms "comprising," "including" and "having" are intended to be inclusive and mean that there may be additional elements other than the listed elements. Although this disclosure has been described with respect to specific embodiments, the details of these embodiments are not to be construed as limitations.

Figure 1:
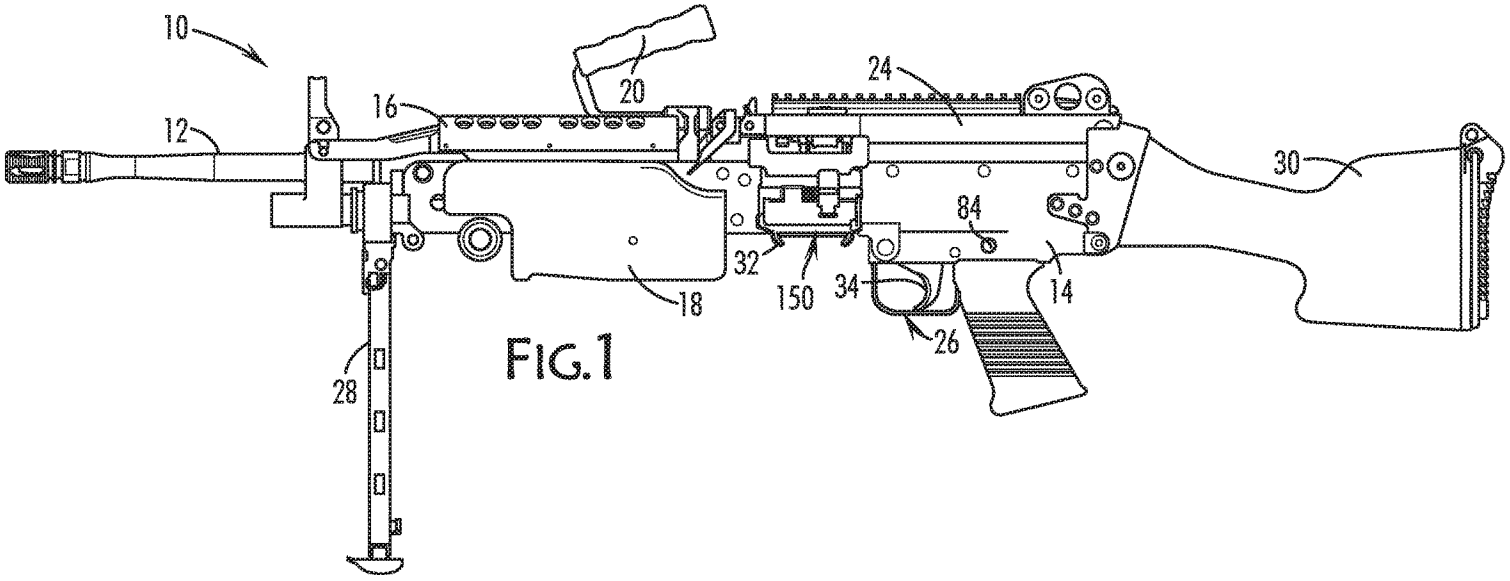
FIG. 1 is a left side view of the semi-automatic rifle, according to an aspect of the disclosure.
Figure 2:
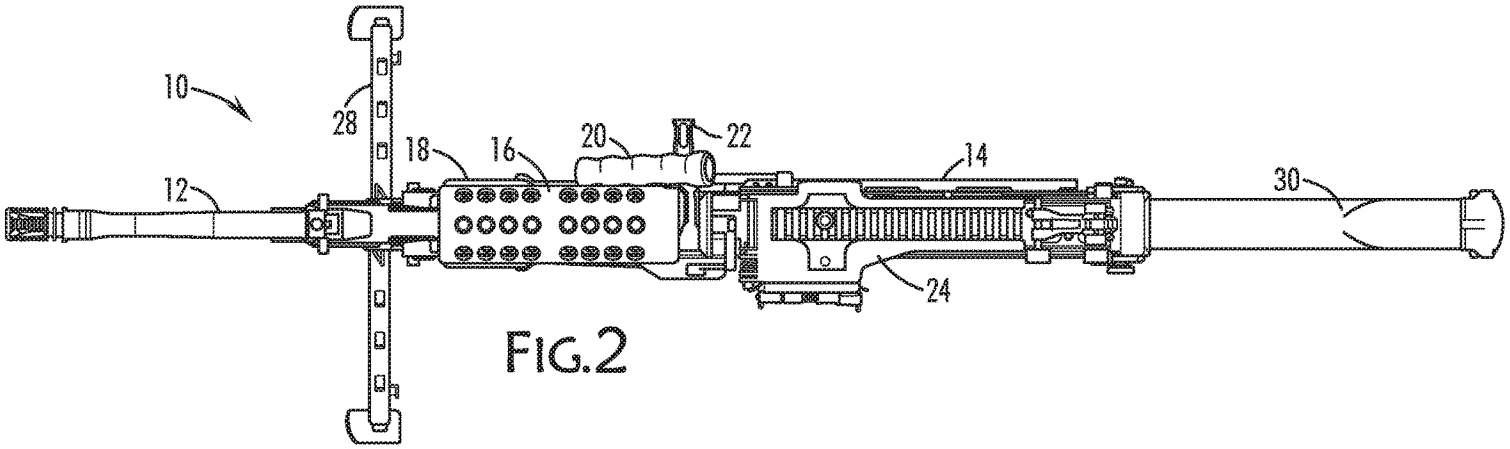
FIG. 2 is a top view of the semi-automatic rifle, according to an aspect of the disclosure.
Figure 3:
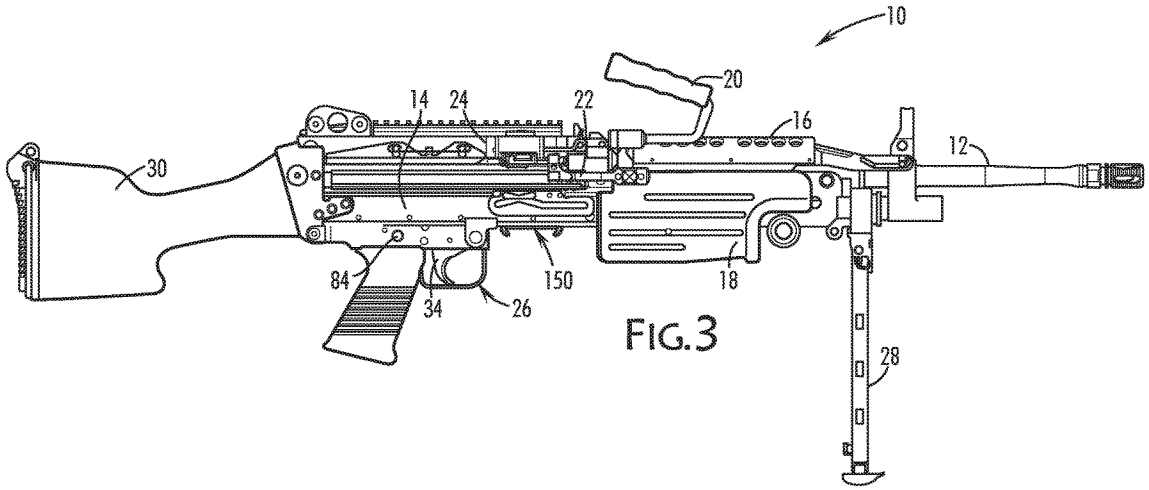
FIG. 3 is a right side view of the semi-automatic rifle, according to an aspect of the disclosure.

As seen in FIGS. 1-3, the present rifle 10 has a barrel 12, a receiver 14, a heat shield 16, and a hand guard 18. It also has a carrying handle 20, a charging handle 22, and a cover plate 24. Below receiver 14 is a trigger assembly 26. Attached to barrel 12 is a bipod 28. On the proximal end of rifle 10 is a buttstock 30.

Rifle 10 is similar in appearance to a military firearm and a light machine gun in particular, because of features such as cover plate 24, the side-mounted charging handle 22, a dovetail ramp 32 for accepting a drum of ammunition (FIG. 1), and the barrel heat shield 16 and hand guard 18. Rifle 10 may receive single rounds of ammunition via a magazine or belt-fed ammunition.

Although the appearance and many of the features of the present rifle 10 are similar to an M249 machine gun, but many are different. For example, its firing mechanism is only semi-automatic rather than fully automatic, that is, pulling and holding the trigger 34 causes only a single round of ammunition to be fired rather than a continuous series of rounds. Trigger 34 must be released for a second round to be fired. See US publication 2012/0144992 published by Landies, et al, which is incorporated herein in its entirety by reference, for a description of the operation of a conventional M249 machine gun.

Figure 4:
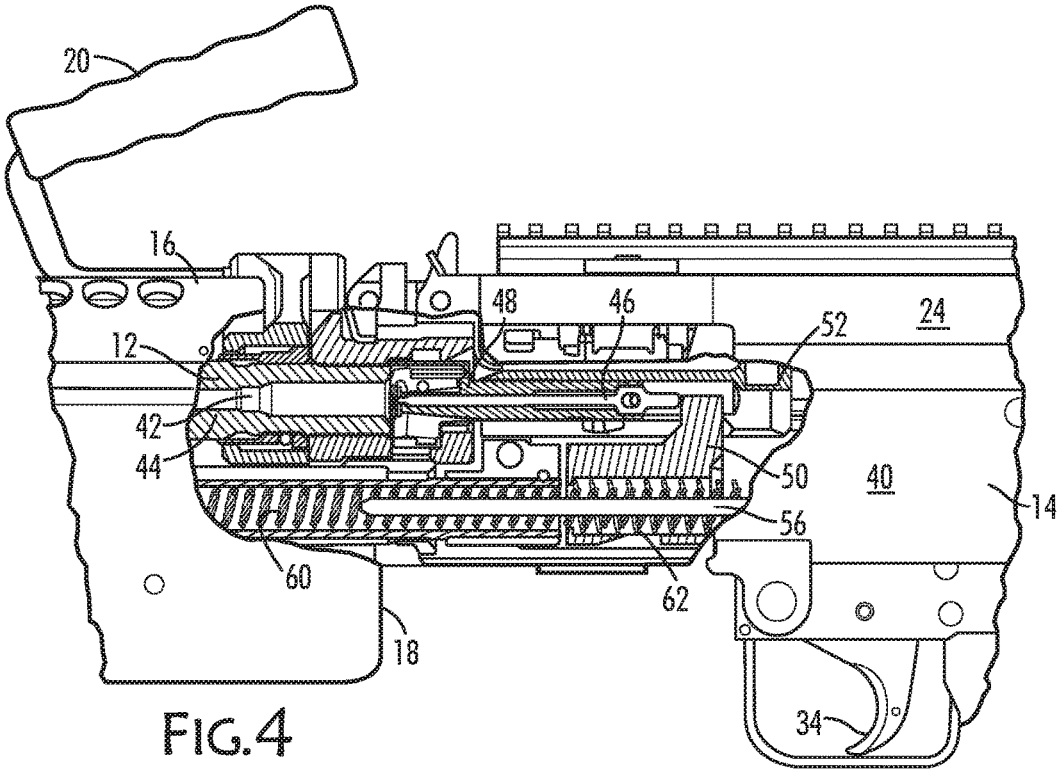
FIG. 4 is a left side, partial cross-sectional, detailed view of the receiver of a semi-automatic rifle, according to an aspect of the disclosure.

FIG. 4 illustrates a left side view of receiver 14 with part of receiver housing 40 cut away to show some of the individual components of receiver 14. A round 42 of ammunition is shown seated in the barrel chamber 44, which is formed in the proximal end of barrel 12 and held in place by the breech face of bolt 48. A firing pin 46 is poised to fire round 42 as its distal tip is just proximal to the primer carried in the proximal end of the shell casing of round 42.

Firing pin 46 is carried inside a bolt 48, shown in cross-section in FIG. 4. Bolt 48 is carried in a bolt carrier 52, which has a slot 138 (seen in FIG. 22), formed therein which receives a portion 130 of a sliding hammer 50, also shown in cross-section in FIG. 4 and in perspective in FIG. 10, which portion 130 is held in position to strike the proximal end of firing pin 46. Sliding hammer 50 has pairs of corresponding grooves 124, 126, on either side that ride on rails 152, 154 (seen in FIG. 22).

The movement of bolt 48 and sliding hammer 50 is controlled in part by two springs, an operating group spring 60 and a firing spring 62. Operating group spring 60 and firing spring 62 are co-axial about an operating rod 56, which are all seen, at least in part, in FIG. 4 (and also in FIG. 12, for example). Firing spring 62, shown in cross-section, has a larger diameter than operating group spring 60 and slows sliding hammer 50 by compressing during the rearward travel of hammer 50 on recoil and then provides the power to drive hammer 50 forward toward bolt 48 and firing pin 46 after being released by sear 70. Spring 60 also compresses when operating group 58 is driven rearward by the diverted gas acting on the piston 114, travels rearward and strikes the hydraulic buffer 136 contained in the butt stock assembly and then extends when operating group 58 moves forward to return bolt 48 to its closed position. During its return from recoil, bolt 48 will strip a round 42 from a magazine or belt of ammunition and seat it in the barrel chamber 44.

Figure 5:
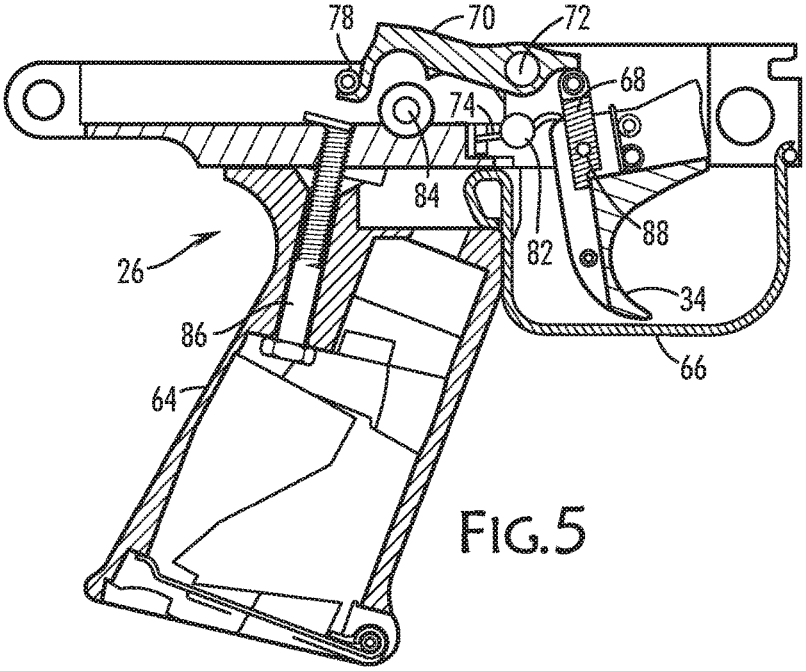
FIG. 5 is a right side, cross-sectional view of a trigger assembly of the semi-automatic rifle, according to an aspect of the disclosure.
Figure 6:
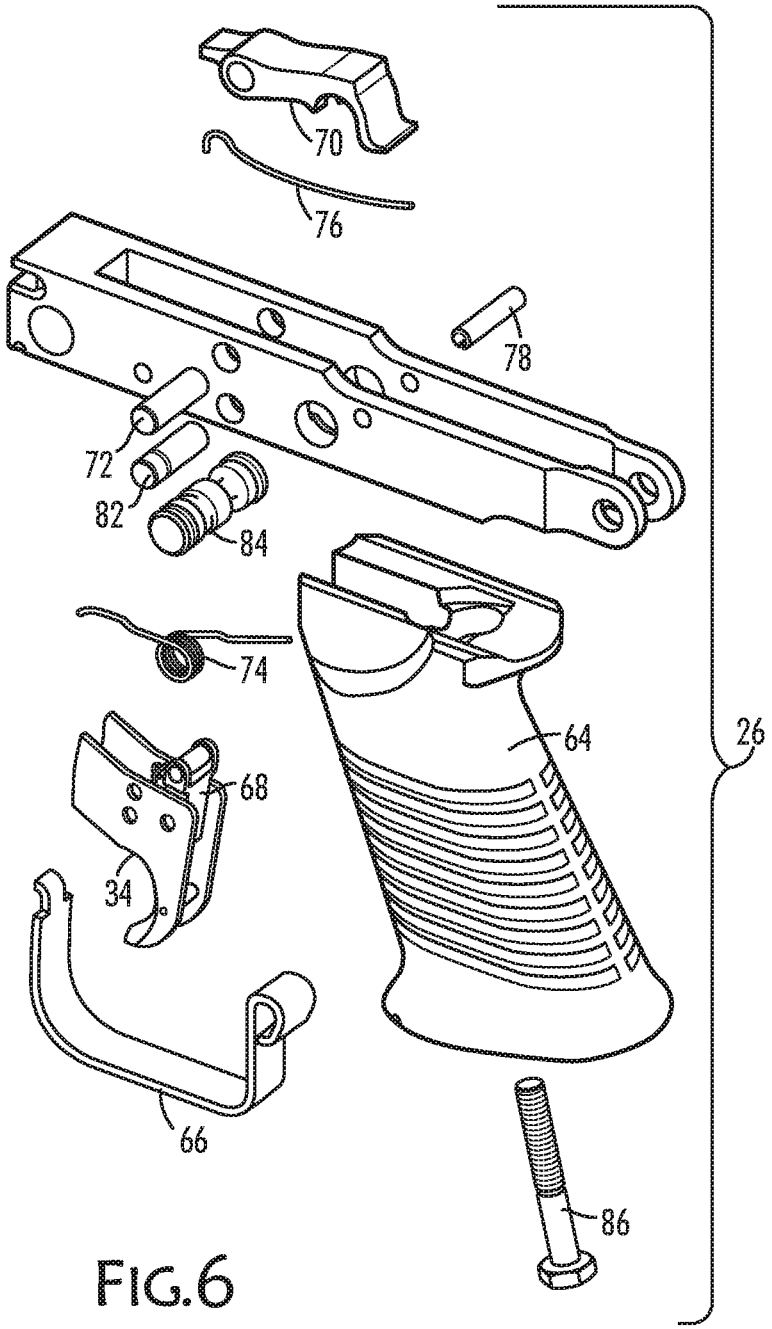
FIG. 6 is a left side, exploded view of the trigger assembly of the semi-automatic rifle, according to an aspect of the disclosure.

FIGS. 5 and 6 show a right side view and a left side exploded view of trigger assembly 26. Trigger assembly 26 includes a pistol grip 64 and a trigger guard 66. Trigger 34 is pulled rearward (to the left in FIG. 5) from its normal released position to a pulled position to fire round 42. When pulled from its released position, trigger 34 lifts a disconnector 68 which pivots the distal end of sear 70 upward. The proximal end of sear 70 then pivots downward about pivot pin 72 which releases sliding hammer 50 from its hammer-catch position to its hammer-release position, as will be described more fully below. A trigger spring 74 resists rearward movement of trigger 34 and urges it forward to its release position. Trigger spring 74 urges sear 70 to return to its hammer-catch position after disconnector 68 pushes sear 70 upwardly to its hammer-release position. Accordingly, trigger 34 is spring-biased to its trigger-release position; sear 70 is spring-biased toward its hammer-catch position.

Upper limit pin 78 limits the upper range of movement of proximal end of sear 70 which is reached when trigger 34 returns to the trigger-release position or disconnector 68 disconnects from sear 70, which produces an audible and tactile click to alert the user that a round 42 will be fired by the next pull of trigger 34. Trigger spring 74 seats on trigger spring pin 82. A safety 84 controls movement of trigger 34 by its axial position, which axial position either blocks or permits movement of trigger 34. Pistol grip 64 is fastened to trigger assembly 26 by a threaded bolt 86.

Figure 7:
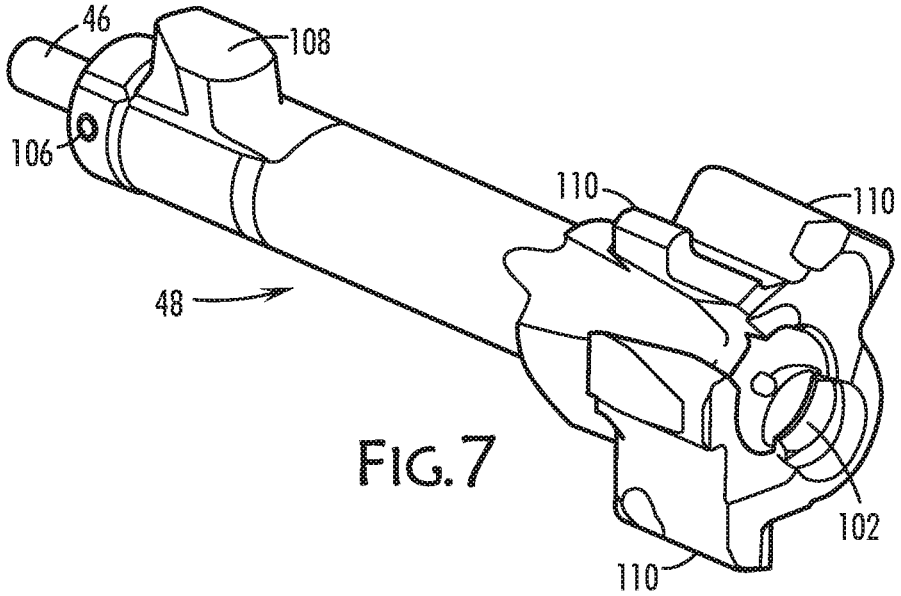
FIG. 7 is a left side perspective view of the bolt of the semi-automatic rifle, according to an aspect of the disclosure.
Figure 8:
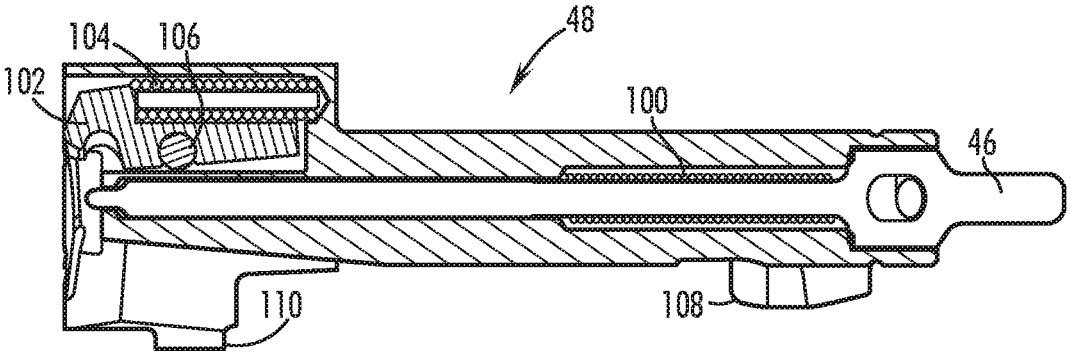
FIG. 8 is a top, cross-sectional view of the bolt of the semi-automatic rifle, according to an aspect of the disclosure.

FIGS. 7 and 8 show bolt 48 in perspective from the right front and in cross-section from the left side, respectively. Bolt 48 holds firing pin 46 which travels with bolt 48 from a distal position locked into barrel 12 to a proximal position toward butt stock 30. Firing pin 46 also moves through only a limited additional range within, and with respect to, bolt 48 when sliding hammer 50 strikes it. When sliding hammer 50 strikes firing pin 46, firing pin 46 moves forward (to the right in FIG. 7, to the left in FIG. 8). Firing pin 46 is shown in its forward-most position in FIG. 8. Forward movement of firing pin 46 loads a compression spring 100 that is relieved soon after the impact of sliding hammer 50 as it urges pin 46 rearward.

Bolt 48 also performs the function of extracting a spent cartridge from barrel chamber 44 using an extractor 102. Extractor 102 pivots around an extractor pivot pin 106 against the rim of the cartridge, which extractor 102 is biased by an extractor spring 104 against the cartridge rim. Finally, lugs 110 on the distal end of bolt 48 strip a new round 42 from a magazine or ammunition belt and seat it in barrel chamber 44.

Bolt 48 also pivots about its own axis as it moves axially. Bolt 48 rides in a bolt carrier 52, seen in FIG. 9. A cam follower 108 on bolt 48 extends through a cam race 98 in cam housing 52 that causes bolt 48 to rotate in one direction through part of an arc as bolt 48 travels in one axial direction and then through the same arc in the reverse direction when bolt 48 reverses its axial movement. Bolt carrier 52 travels forward and rearward on rails 118, 120 (best seen in FIG. 22).

Figure 9:
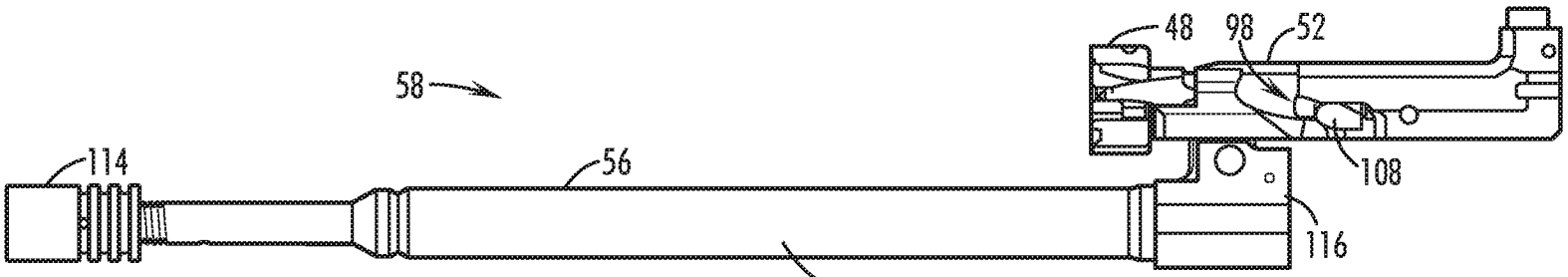
FIG. 9 is a left side, exterior view of the operating group showing the bolt and operating rod, according to an aspect of the disclosure.

FIG. 9 shows operating group 58 with an operating rod 56 carrying a piston 114 threaded to its distal end and a fitting 116 on its proximal end for attachment to bolt carrier 52. As operating rod 56 moves forward and rearward, bolt carrier 52 and bolt 48 travel with it, moving rearward on recoil from the closed bolt position, in which bolt 48 is radially unlocked from barrel 12, and then forward to the closed bolt position again in the next firing cycle. Piston 114 fits into the gas cylinder of rifle that receives a portion of the combustion gas from the firing of round 42 through a hole in barrel 12 which gas drives piston 114 and the balance of operating group 58 rearward.

Figure 10:
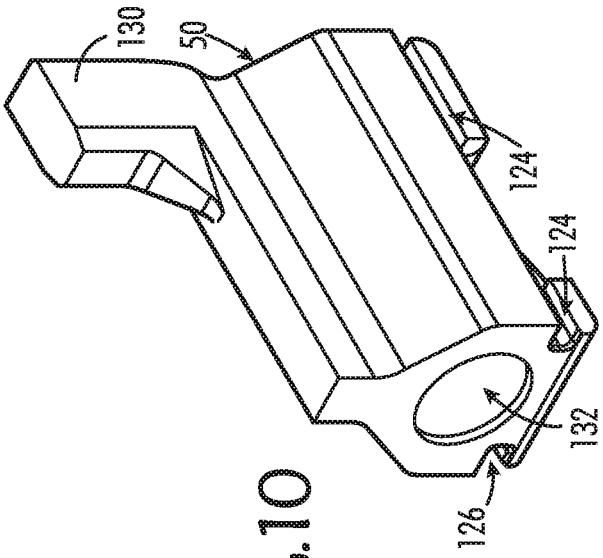
FIG. 10 is a left side, perspective view of the hammer of the semi-automatic rifle, according to an aspect of the disclosure.
Figure 22:
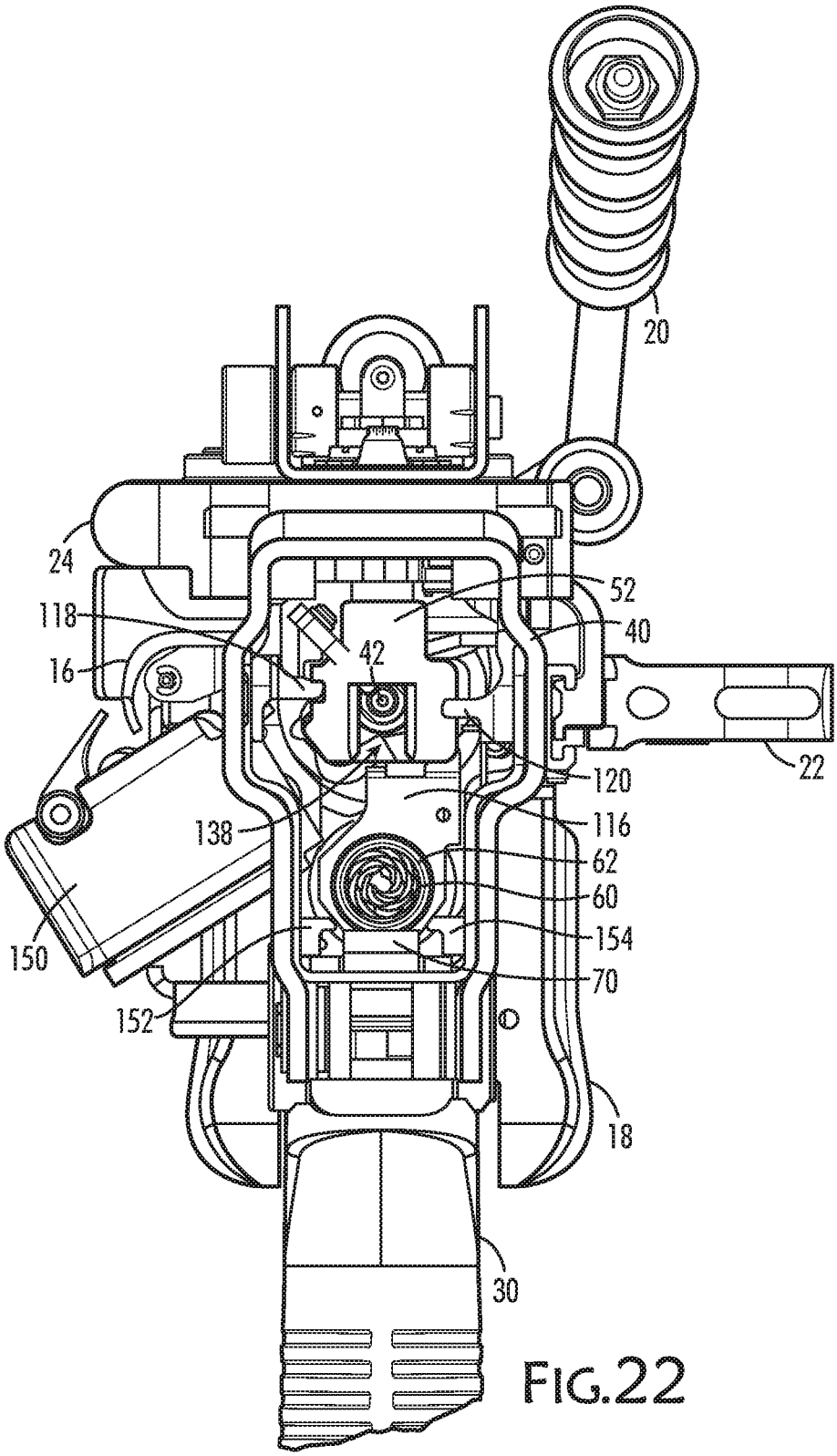
FIG. 22 is an end cross sectional view of the receiver, according to an aspect of the disclosure.

FIG. 10 shows sliding hammer 50 with the firing pin-engaging portion 130 extending upward from sliding hammer 50 where it will be received in a slot 138 in bolt carrier 52 (seen best in FIGS. 4 and 22). Sliding hammer 50 has an axial hole 132 formed in it for receiving operating group spring 60, firing spring 62 and operating pin 134.

FIGS. 11-21 illustrate relative movements of the present rifle 10 during sequential parts of the firing cycle. FIGS. 11, 14, 16, 18, and 21 show the right side of receiver 14 with housing 40 removed. FIGS. 12, 13, 15, 17, 19, and 20 show the left side of receiver 14.

Figure 11:
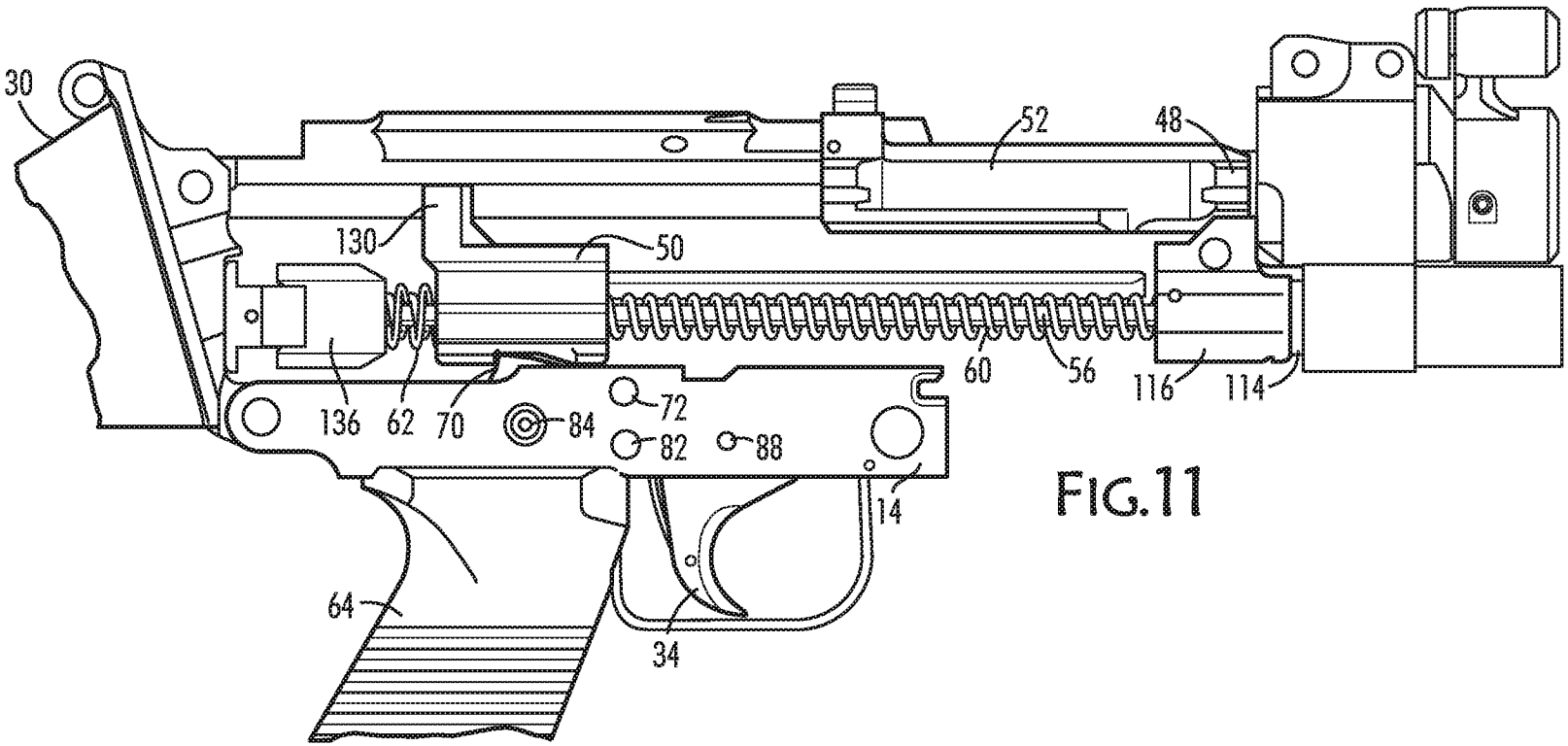
FIG. 11 is a right side view of the interior of the receiver of the semi-automatic rifle, according to an aspect of the disclosure.
Figure 12:
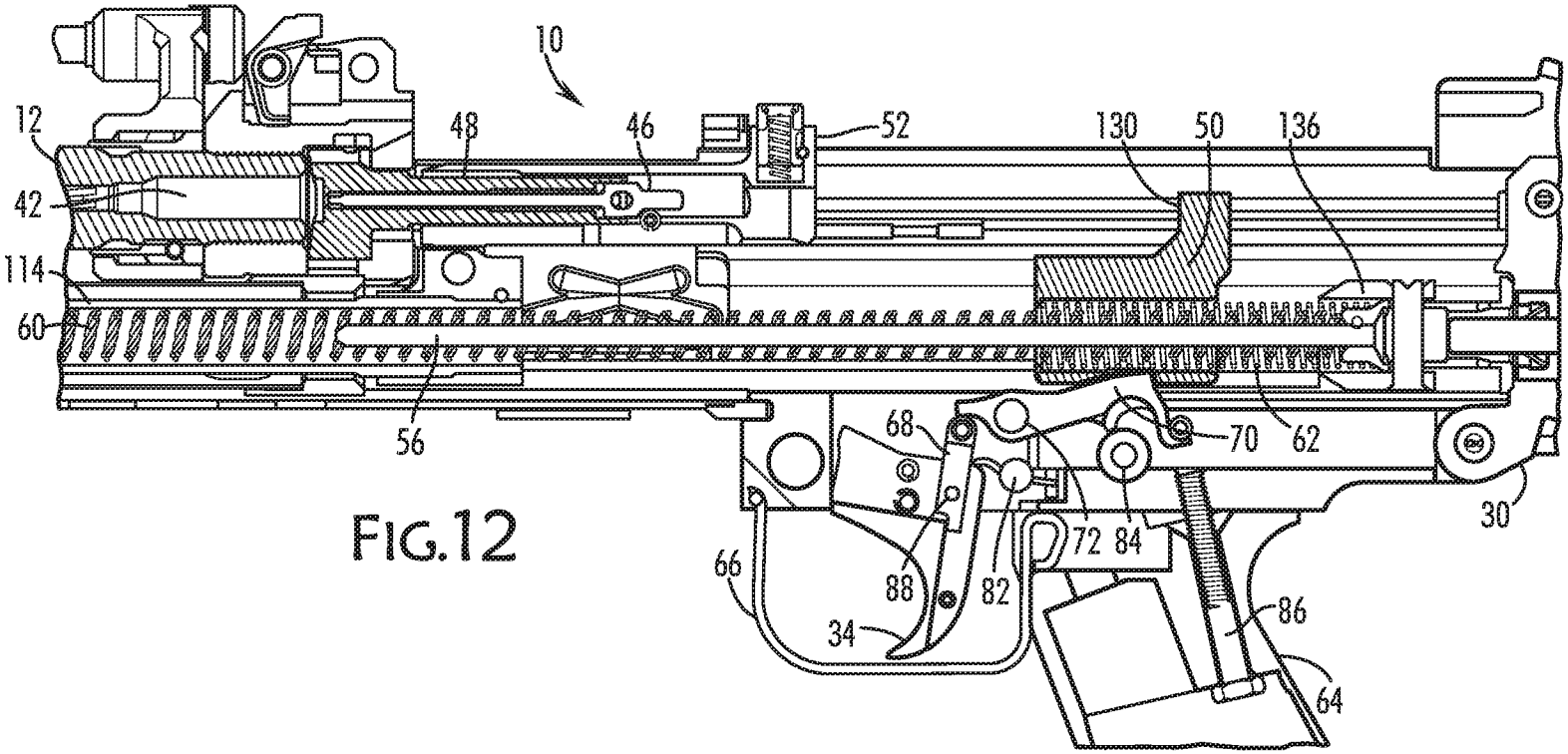
FIG. 12 is a left side view of the interior of the receiver and part of the barrel of the semi-automatic rifle with the bolt shown in cross-section revealing the hammer on the sear, according to an aspect of the disclosure.

In FIG. 11 shows sliding hammer 50 held by sear 70, urged forward by firing spring 62, with bolt 48 forward in receiver 14 in its closed position and radially locked in barrel 12. Firing spring 62 is compressed, ready to propel sliding hammer 50 forward. Trigger 34 is in its released position. In FIG. 12, trigger 34, in its released position, and sear 70 in its hammer catch position so sliding hammer 50 is held in place.

Figure 13:
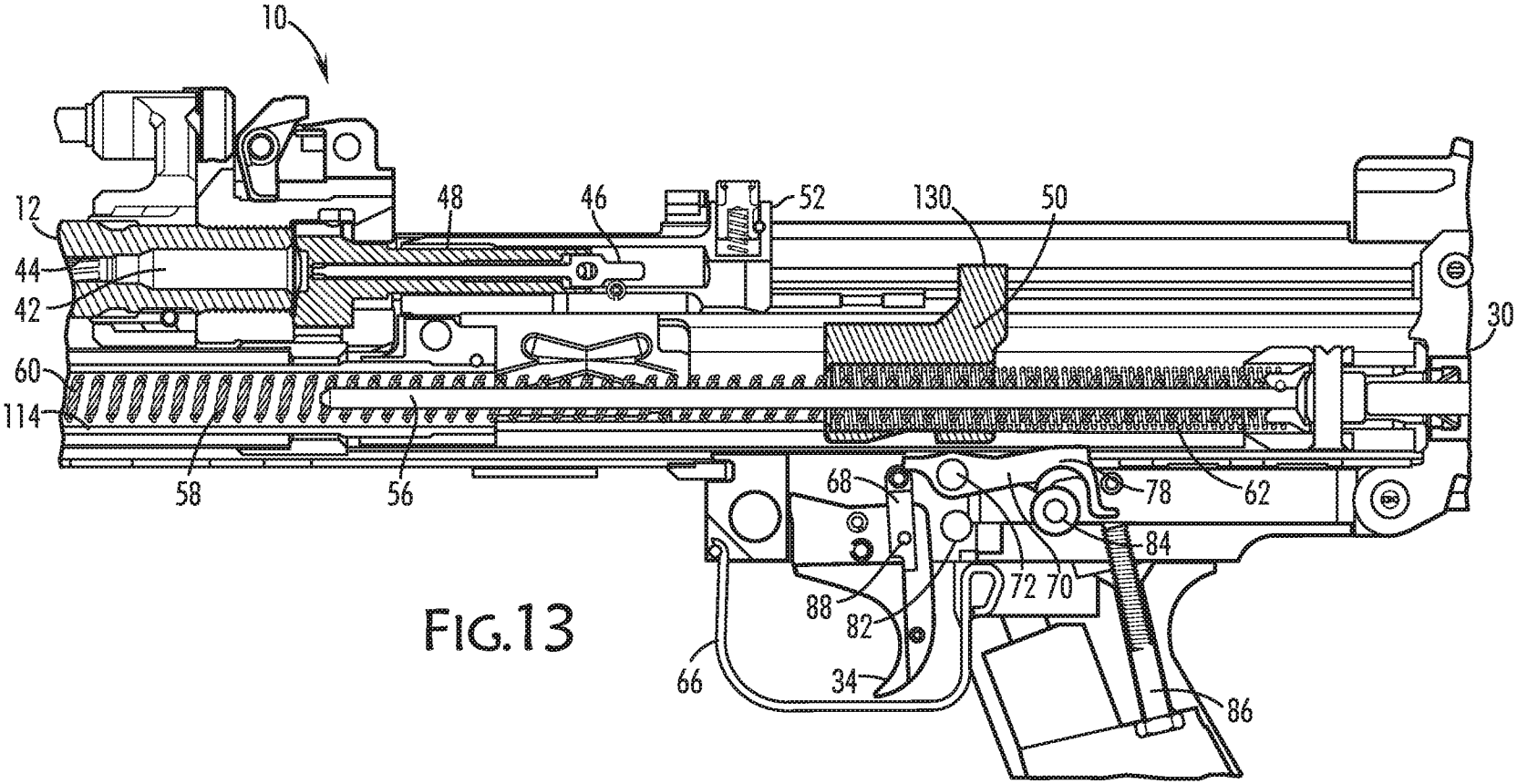
FIG. 13 is a left side view of the interior of the receiver and part of the barrel of the semi-automatic rifle with the bolt shown in cross-section revealing the hammer moving toward the firing pin, according to an aspect of the disclosure.

In FIG. 13, trigger 34 is in its pulled position, which lifts disconnector 68 that in turn pivots sear 70 so its proximal end rotates up and its distal end rotates down, thereby releasing hammer 50.

Figure 14:
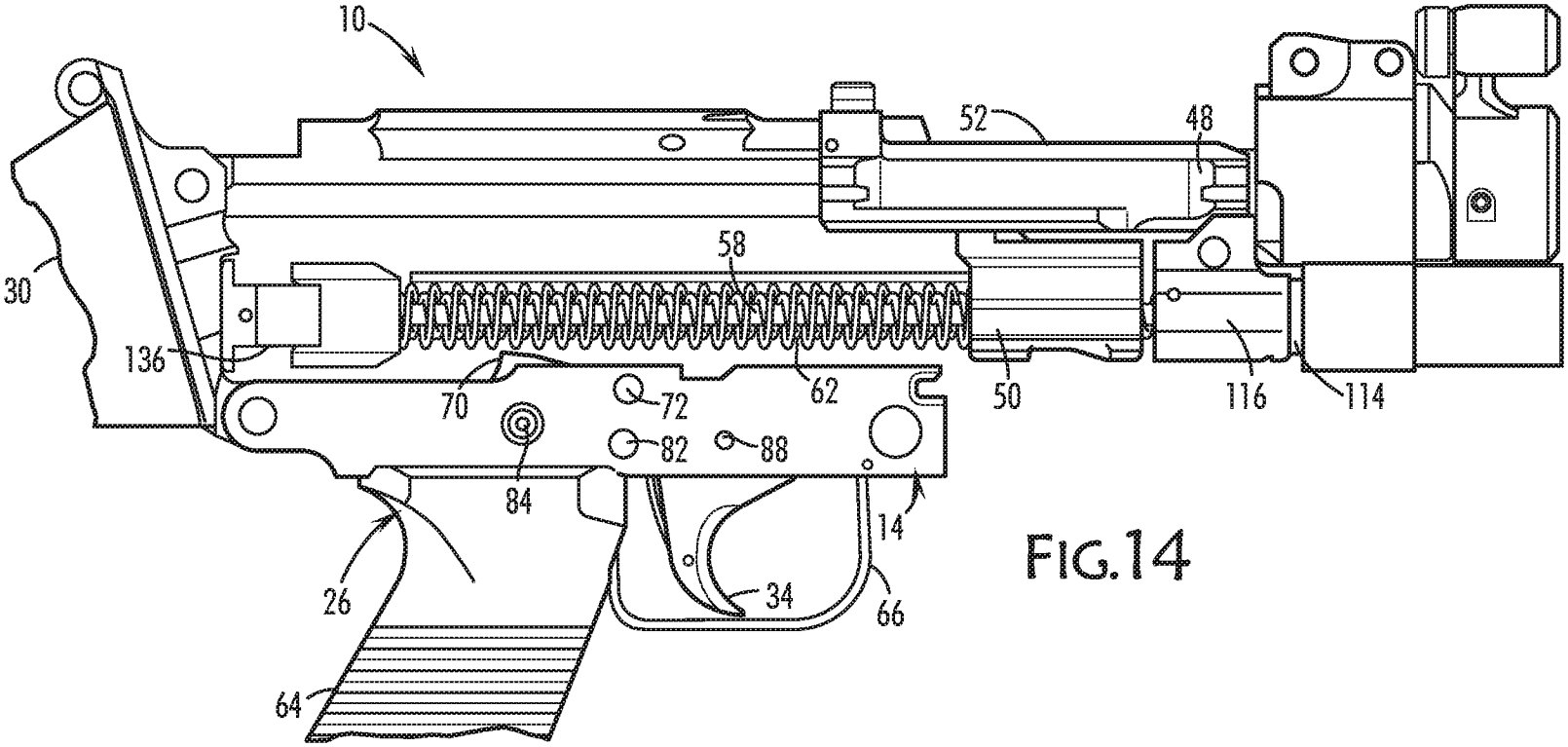
FIG. 14 is a right side view of the interior of the receiver showing the position of the hammer at the moment it strikes the firing pin, according to an aspect of the disclosure.
Figure 15:
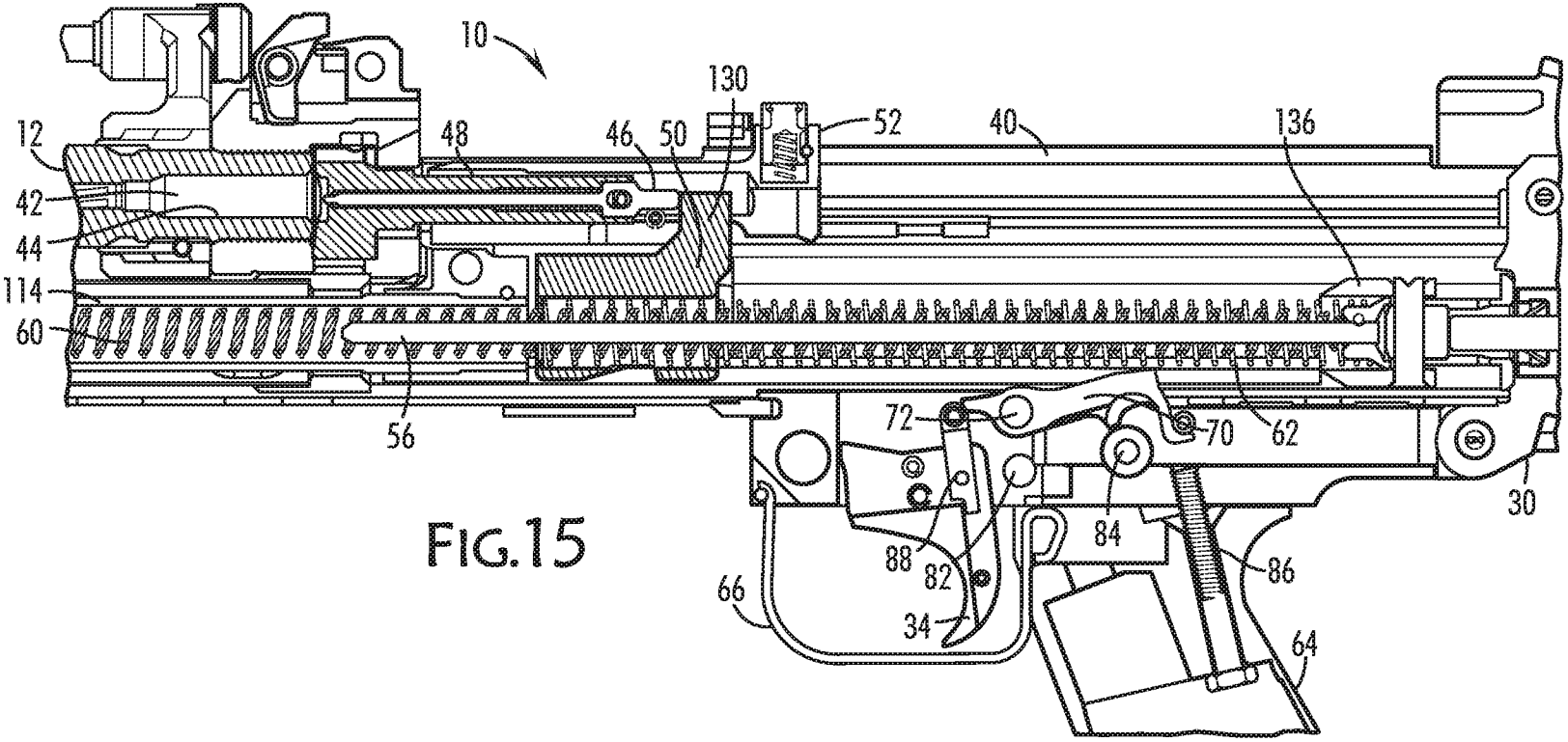
FIG. 15 is a left side view of the interior of the receiver showing the hammer at the moment it strikes the firing pin, according to an aspect of the disclosure.

In FIGS. 14 and 15, sliding hammer 50 has moved forward far enough so that its engaging portion 130 (see FIGS. 10 and 15) has entered slot 138 in proximal end of bolt carrier 48 (see FIGS. 15 and 22) and is poised to strike firing pin 46 (FIG. 15). Note that sear 70 has already been reset by the biasing force of sear spring 76.

Figure 16:
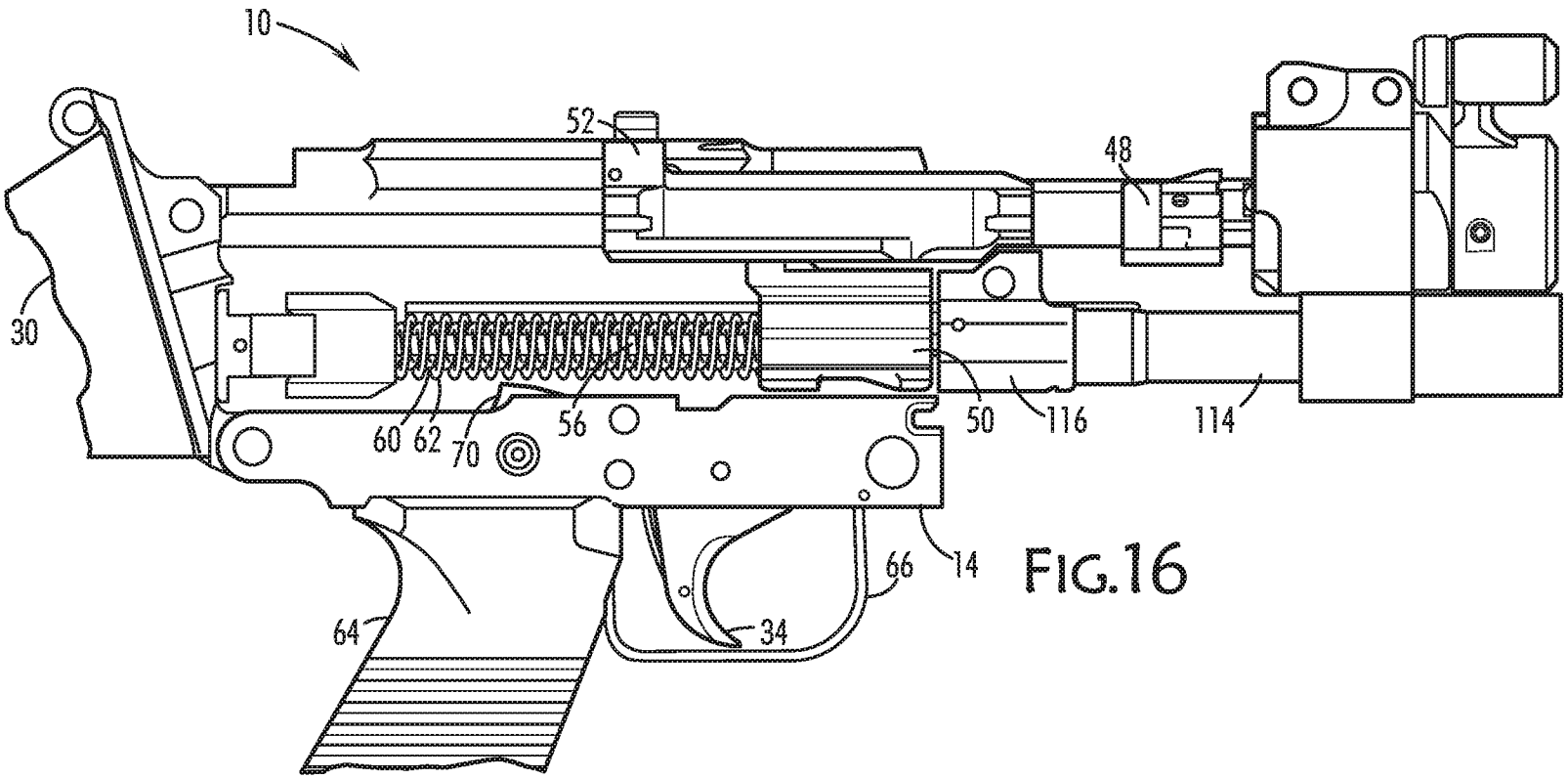
FIG. 16 is a right side view of the interior of the receiver with the hammer and bolt in the process of recoiling after firing a round, according to an aspect of the disclosure.
Figure 17:
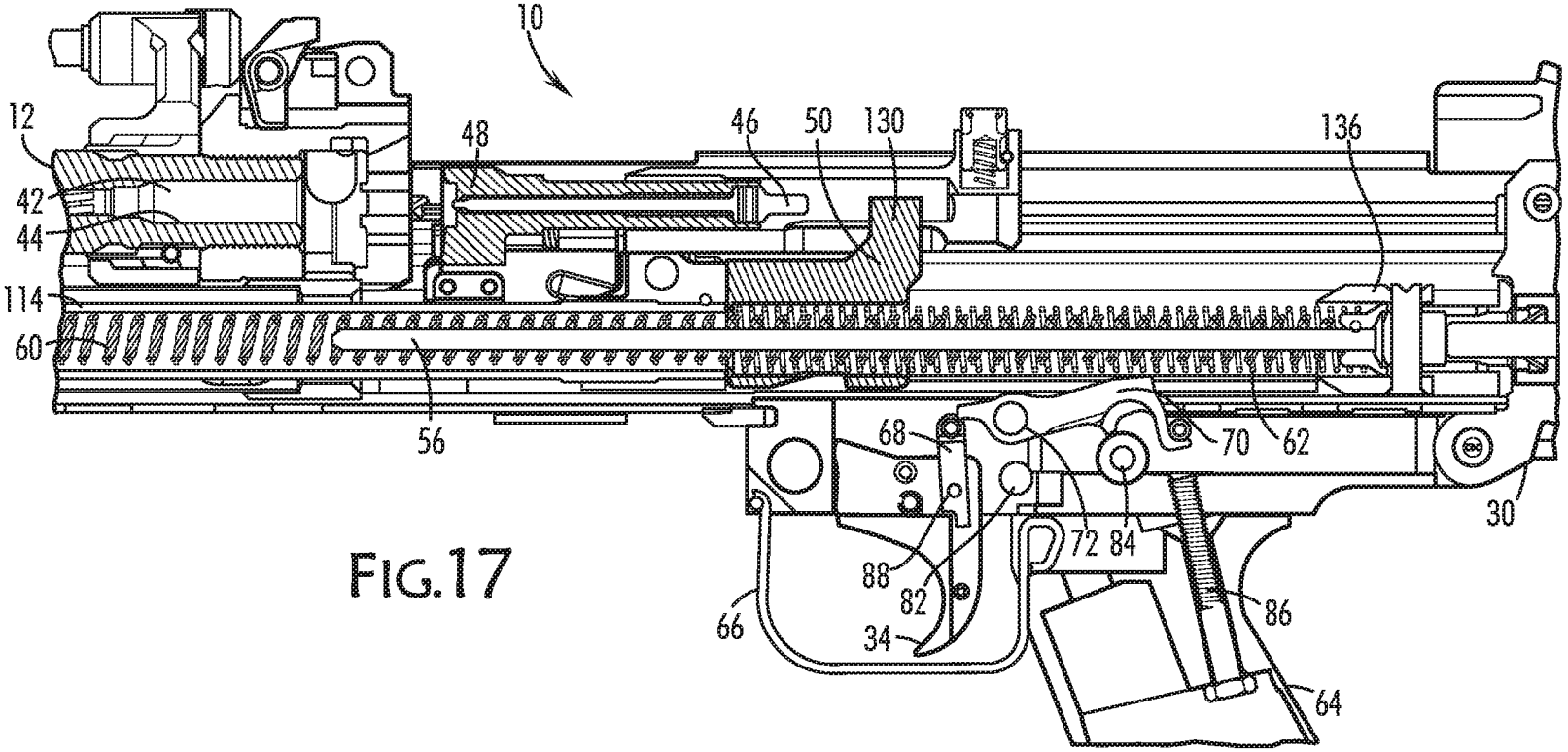
FIG. 17 is a left side view of the interior of the receiver with the hammer and bolt partially recoiled after firing a round, according to an aspect of the disclosure.

FIGS. 16 and 17 show sliding hammer 50, now moving rearward toward buffer 136 in butt stock 30 following the firing of round 42 of ammunition. The proximal end of sear 70 is cammed downward by the movement of sliding hammer 50 as it travels rearward but sear 70 immediately resets to its hammer-catch position to catch sliding hammer 50 when it moves forward again. Operating group 58 moves rearward with sliding hammer 50.

Figure 18:
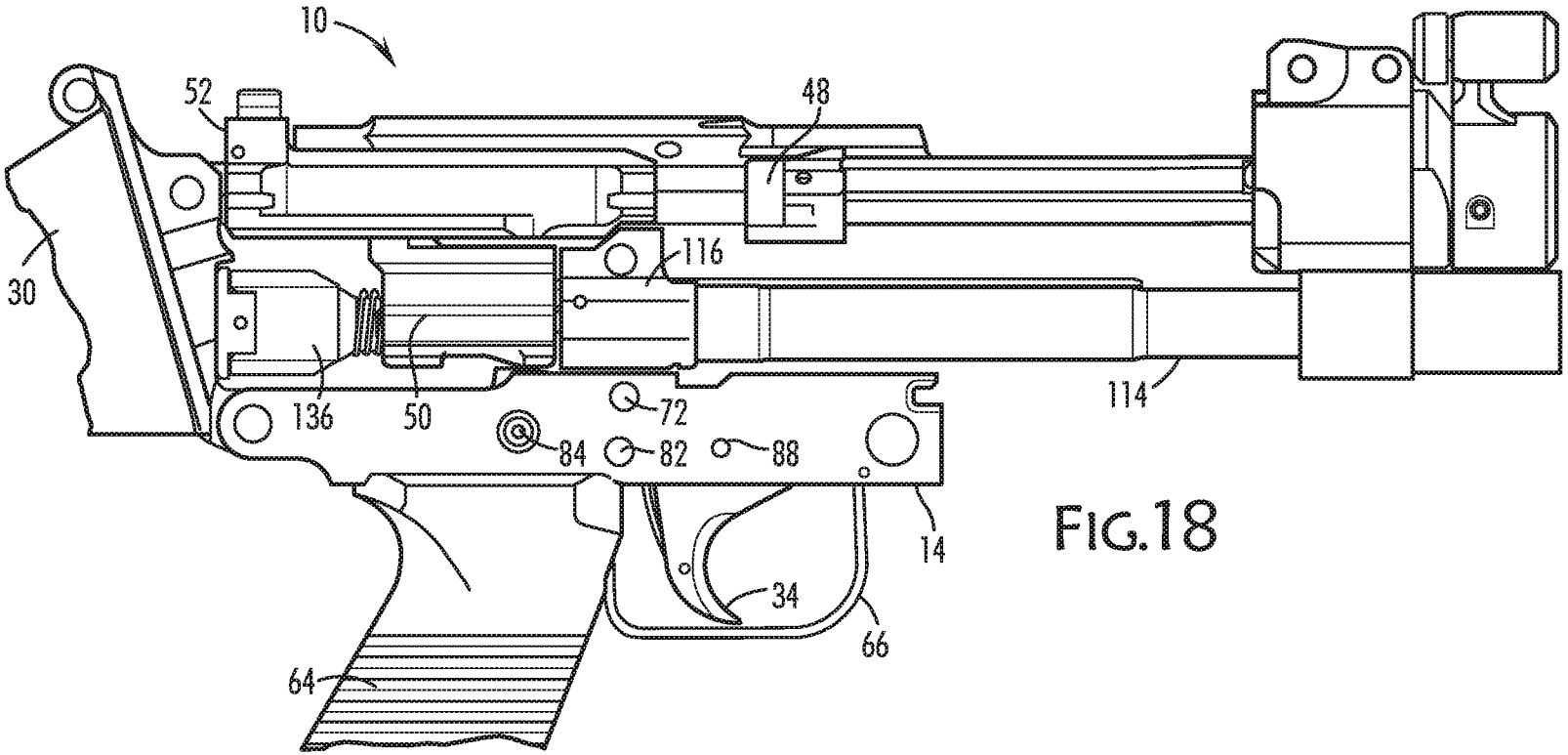
FIG. 18 is a right side view of the interior of the receiver showing the bolt and hammer fully recoiled, according to an aspect of the disclosure.
Figure 19:
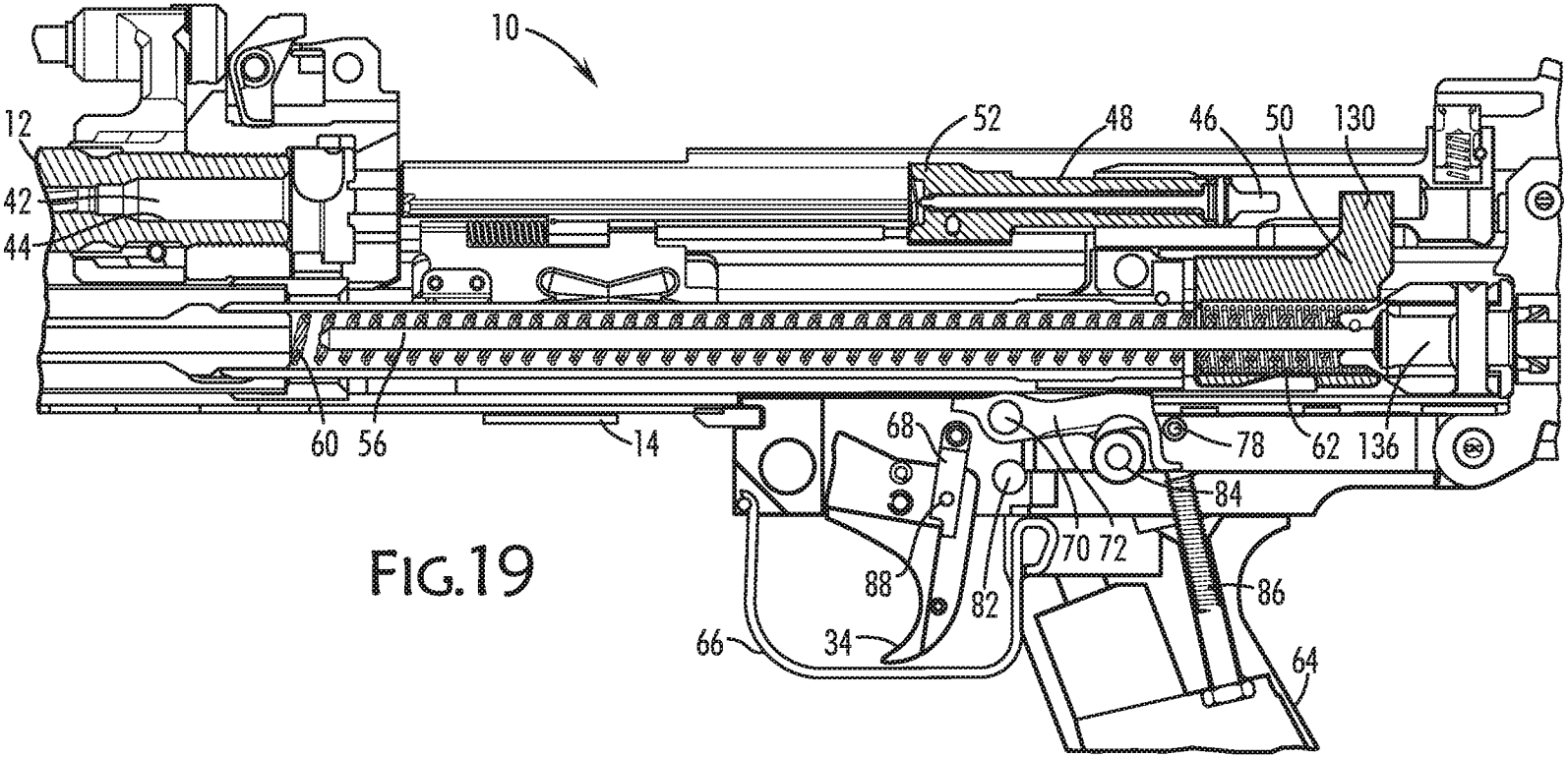
FIG. 19 is a left side view of the interior of the receiver showing the bolt and hammer fully recoiled, according to an aspect of the disclosure.

FIGS. 18 and 19 show sliding hammer 50 having reached buffer 136 carried on the distal end of butt stock 30 and which stops rearward movement of sliding hammer 50. Operating group 58 also reaches its rearward-most position with sliding hammer 50. Sear 70 is set to catch sliding hammer 50 as it rebounds off buffer 136.

Figure 20:
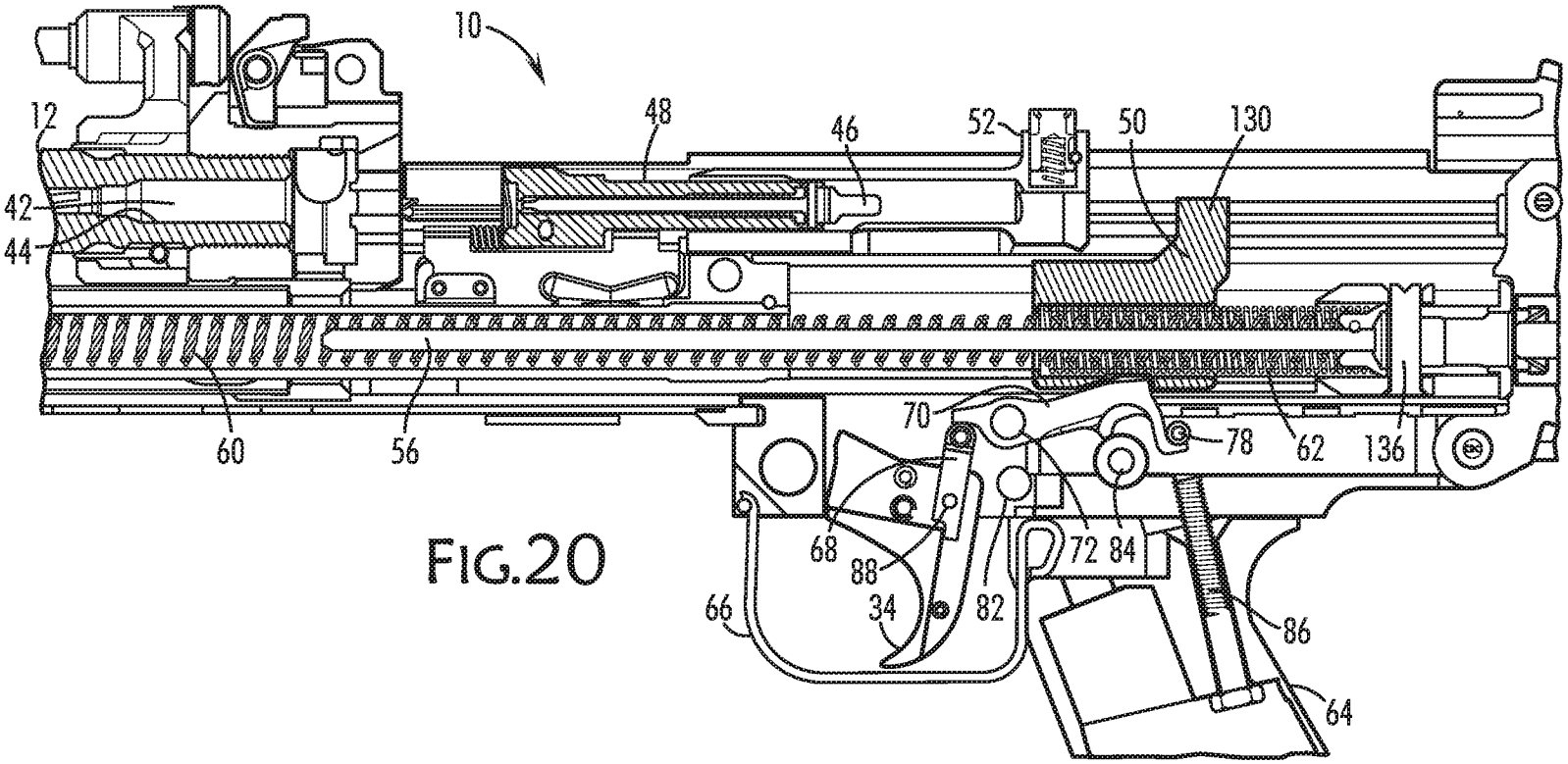
FIG. 20 is a left side view of the interior of the receiver showing the bolt and hammer returning after recoil and with the hammer now caught by the sear, according to an aspect of the disclosure.
Figure 21:
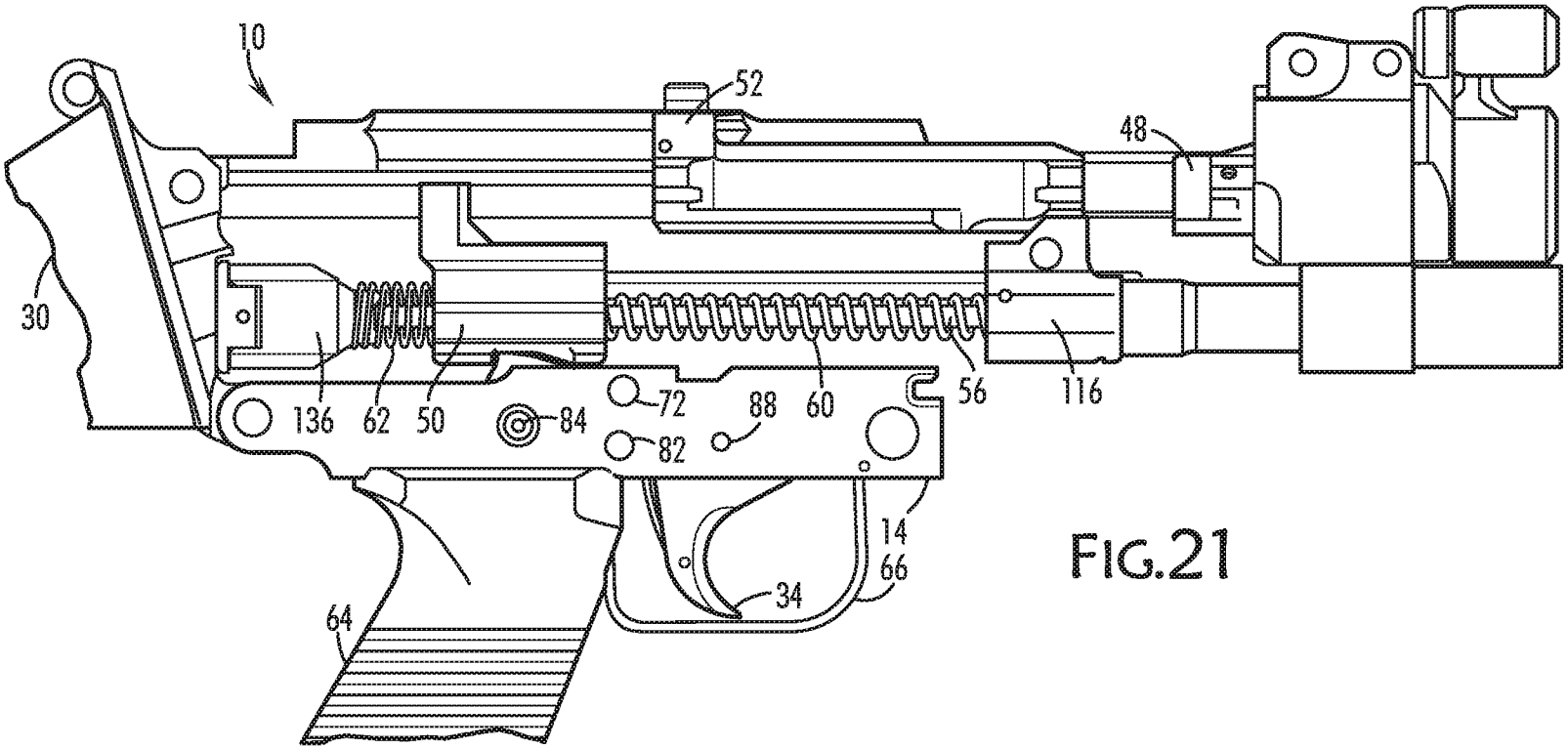
FIG. 21 is a right side view of the interior of the receiver showing the bolt closing into the barrel and the hammer held by the sear and poised to move forward once the trigger is pulled, according to an aspect of the disclosure.

FIGS. 20 and 21 show sliding hammer 50, urged by firing spring 62, moving forward to the point where it is caught by sear 70, its forward movement halted. Operating group 58, however, continues its forward motion, separating from sliding hammer 50. Bolt 48 again radially closes on barrel 12 as shown in FIGS. 11 and 12 for the firing cycle to begin again.

FIG. 22 shows a perspective, cross-sectional view of rifle 10. Carrying handle 20 is shown in top right, above charging handle 22. A magazine well 150 is shown on the left. Firing pin 46 is partially obscured by bolt carrier 52 but visible in through slot 138 in bolt carrier 52. The rear part of the operating rod 116 appears below bolt carrier 52 and operating group spring 60 and firing spring 62 are shown in it with firing spring 62 being the spring of larger diameter. The top of sear 70 is shown below rear part 116. Operating group spring 60 and firing spring 62 are also visible through hole 132 of sliding hammer 50. Sear 70 is shown below hammer 50.

Rails 118, 120 on which bolt carrier 52 rides are seen to its left and right, respectively. Additional rails 152, 154, which are received in grooves 124, 126 of sliding hammer 50 are shown below that on either side of sear 70.

Those skilled in firearms will appreciate from the foregoing description of aspects of the disclosure that many substitutions and modifications may be made without departing from the spirit and scope of the disclosed rifle, which is defined by the appended claims.

What is claimed is:

1. A rifle, comprising:

a barrel having a forward end and a rearward end, and having a chamber formed in said rearward end;

a buttstock;

a receiver having a forward end and an opposing rearward end, said forward end of said receiver being attached to said rearward end of said barrel, said rearward end of said receiver being attached to said buttstock, said receiver including a magazine well, a pivotal top cover having an open position and a closed position, wherein, when ammunition is provided in a belt, said top cover pivots to said open position to receive said belt and pivots to said closed position over said belt;

a bolt;

a firing pin carried by said bolt;

a slide hammer having a hole formed therein;

a spring system for urging said hammer to move forward in said receiver, wherein said spring system comprises an operating group spring coaxial with a firing spring, wherein said firing spring has a larger diameter than said operating group spring, and wherein said firing spring and said operating group spring extend through said hole in said sliding hammer;

a trigger assembly attached to said receiver, said trigger assembly including a trigger having a pulled position and a released position; and a sear operatively connected to said trigger and pivotable on movement of said trigger, wherein, when said trigger is pulled to said pulled position from said released position, said sear pivots from a slide hammer-catch position to a slide hammer release position, and said sear pivots back to said slide hammer-catch position from said slide hammer-release position after said slide hammer is released by said sear.

2. The rifle of claim 1, further comprising a sear spring, and wherein said sear spring urges said sear to pivot back to said slide hammer-catch position from said slide hammer-release position after said slide hammer is released by said sear.

3. The rifle of claim 1, wherein said sear has a proximal end and a distal end with a pivot pin between said proximal and said distal ends about which said sear pivots, and wherein said trigger assembly further comprises a disconnector located between said trigger and said sear, said disconnector being operatively connected to said trigger and said sear.

4. The rifle of claim 3, said disconnector connecting movement of said trigger to movement of said sear, wherein, when said trigger moves to said pulled position from said release position, said disconnector lifts said distal end of said sear thereby lowering said proximal end of said sear so that said sear moves from said hammer-catch position to said hammer-release position.

5. The rifle of claim 1, wherein said receiver includes two opposing rails, said slide hammer riding on said rails between said forward end and said rearward end of said receiver.

6. The rifle of claim 1, wherein said trigger assembly includes a pistol grip.

7. The rifle of claim 1, further comprising a heat shield extending over said barrel; and a hand guard extending under said barrel.

8. The rifle of claim 1, further comprising a carrying handle pivotally attached to said barrel assembly.

9. The rifle of claim 1, wherein barrel is formed with a cartridge chamber in said rearward end and said receiver further comprises a charging handle having a forward position and a rearward position, said charging handle being movable between said forward position and said rearward position intended as an operation group release position to seat a round of ammunition in said chamber of said barrel.

10. A rifle, comprising:

a barrel having a distal end and a proximal end, said barrel having a chamber formed in said proximal end;

a buttstock;

a receiver having a distal end and an opposing proximal end, said distal end being attached to said proximal end of said barrel, said proximal end of said receiver being attached to said buttstock, said receiver including a bolt carrier, a bolt carried by said bolt carrier, wherein said bolt carrier has a slot formed therein, a firing pin carried within said bolt, a pivoting cover having an open position and a closed, said cover pivotable to said open position to place a belt of ammunition in said distal end of said receiver, a charging handle having a forward position and a rearward position, said charging handle being movable from said forward position to said rearward position and therefore released under spring force with said bolt to strip a first round of ammunition from said belt when moving to said forward positon from said rearward position and to insert said first round of ammunition into said barrel chamber, with said bolt breech rotationally locked in place, an operating rod having a distal end and a proximal end, a sliding hammer having a hole formed therein, said hole dimensioned to receive said operating rod, said sliding hammer sliding between said distal end of said operating rod and said proximal end of said operating rod, and wherein said sliding hammer has an extension dimensioned to fit into said slot of said bolt carrier, said extension striking said firing pin when said extension of said sliding hammer is received in said slot, and a spring system for urging said sliding hammer to slide to said distal end of said operating rod; and a trigger assembly attached to said receiver, said trigger assembly including a trigger having a pulled position and a released position, said trigger assembly including a disconnector located between said trigger and said sear, said disconnector being operatively connected to said trigger and said sear, and a sear operatively connected to said disconnector, said sear pivotable between a slide hammer-catch position and a slide hammer-release position, wherein, when said sear moves from said hammer-catch position to said slide hammer-release position, said sliding hammer slides on said operating rod toward said forward end of said receiver in response to urging by said spring system, and wherein said sear returns to said hammer-catch position so that said sliding hammer does not fire a second round of ammunition until said trigger is again pulled from said released position to said pulled position.

11. The rifle as recited in claim 10, wherein said spring system further comprises an operating group spring and a firing spring, said operating group spring extending when said hammer moves from said distal end to said proximal end of said receiver, and said firing spring extending when said operation rod moves from said distal end to said proximal end.

12. The rifle as recited in claim 10 wherein said spring system includes a firing spring and an operating group spring.

13. The rifle as recited in claim 12, wherein firing spring and said operating group spring are coaxial.

14. The rifle as recited in claim 13, wherein said firing spring has a larger diameter than said operating group spring.

15. The rifle as recited in claim 13, wherein said firing spring and said operating group spring are coaxial with said operating rod and extend through said hole in said sliding hammer.

16. The rifle as recited in claim 10, wherein said receiver has a housing with rails formed on the interior of said housing, said sliding hammer riding on said rails between said proximal end of said receiver and said distal end of said receiver.

17. The rifle of claim 10, wherein said receiver has a housing, said housing having an interior defined by a wall, and wherein said wall has rails formed thereon, and wherein said bolt carrier rides on said rails between said forward end of said receiver and said rearward end of said receiver.

18. The rifle of claim 10, wherein said receiver includes a magazine well and an ammunition belt ramp.

19. The rifle of claim 15, further comprising a heat shield extending over said barrel and a hand guard extending under said barrel.

* * * * *